US007762400B2

(12) United States Patent
Hall et al.

(10) Patent No.: US 7,762,400 B2
(45) Date of Patent: Jul. 27, 2010

(54) PACKAGING TRAY

(75) Inventors: Robert Sinclair Hall, Hampshire (GB); Roderick Iain Davidson, Hampshire (GB)

(73) Assignee: Easy Pad Limited, Horndean, Hampshire (GB)

( * ) Notice: Subject to any disclaimer, the term of this patent is extended or adjusted under 35 U.S.C. 154(b) by 227 days.

(21) Appl. No.: 11/793,066

(22) PCT Filed: Dec. 20, 2005

(86) PCT No.: PCT/GB2005/004936

§ 371 (c)(1),
(2), (4) Date: Feb. 2, 2008

(87) PCT Pub. No.: WO2006/067413

PCT Pub. Date: Jun. 29, 2006

(65) Prior Publication Data

US 2009/0114552 A1 May 7, 2009

(30) Foreign Application Priority Data

Dec. 22, 2004 (GB) ..... 0428102.8
Apr. 15, 2005 (GB) ..... 0507654.2
Sep. 29, 2005 (GB) ..... 0519826.2

(51) Int. Cl.
*B65D 81/26* (2006.01)

(52) U.S. Cl. ..... 206/564; 206/204; 206/0.5; 426/129

(58) Field of Classification Search ..... 206/564, 206/204, 0.5, 0.6, 0.7; 426/0.124, 129
See application file for complete search history.

(56) References Cited

U.S. PATENT DOCUMENTS 2,814,381 A 11/1957 Stevick
2,918,379 A 12/1959 Lurie
3,026,209 A * 3/1962 Niblack et al. ..... 426/124
3,151,799 A 10/1964 Engels et al.

(Continued)

FOREIGN PATENT DOCUMENTS

CH 663943 1/1988

(Continued)

OTHER PUBLICATIONS

U.S. Appl. No. 11/559,653, filed Nov. 14, 2006.

(Continued)

*Primary Examiner*—Ehud Gartenberg
*Assistant Examiner*—Ernesto A Grano
(74) *Attorney, Agent, or Firm*—Baker Botts LLP

(57) ABSTRACT

A packaging tray including an outer tray (1), having a base (4) and side walls (2) defining a packaging space and false bottom (10) of the tray defining a discrete exudate-collection compartment immediately above the base and reducing the packaging space by the size of the discrete compartment. The false bottom is peripherally connected to the walls and provided with an array of perforations (36) in a discrete minor central region (20) to allow exudate to pass through itself into the exudate-collection compartment. In addition, the tray includes means (28, 30) for gas transfer between the exudate-collection compartment and the packaging space, in addition to and separate from the perforations in the false bottom, and including means inhibiting flow exudate back into the packaging space.

21 Claims, 5 Drawing Sheets

U.S. PATENT DOCUMENTS

| | | | | |
|---|---|---|---|---|
| 3,155,303 | A | 11/1964 | Fenkel | |
| 3,264,120 | A | 8/1966 | Westcott | |
| T860,020 | I4 | 3/1969 | Anderson | |
| 3,885,728 | A * | 5/1975 | Gilley | 229/407 |
| 3,932,575 | A | 1/1976 | Andersson | |
| 4,576,278 | A * | 3/1986 | Laiewski et al. | 206/204 |
| 4,664,922 | A * | 5/1987 | Leon et al. | 426/124 |
| D294,466 | S | 3/1988 | Culver | |
| 4,949,897 | A * | 8/1990 | Pawlak et al. | 229/407 |
| 5,266,763 | A * | 11/1993 | Colombo | 219/734 |
| 5,352,416 | A | 10/1994 | Wagner | |
| 5,456,379 | A * | 10/1995 | Krupa et al. | 220/835 |
| 5,705,213 | A * | 1/1998 | Guillin | 426/129 |
| 5,720,999 | A * | 2/1998 | Lanzani et al. | 426/129 |
| 6,269,946 | B1 | 8/2001 | Colombo | |
| 6,619,501 | B2 * | 9/2003 | Hayes et al. | 220/608 |
| 6,627,273 | B2 * | 9/2003 | Wolf et al. | 428/34.9 |
| 6,671,578 | B1 * | 12/2003 | D'Amelio et al. | 700/225 |
| 6,983,575 | B2 * | 1/2006 | Longo | 53/432 |
| 2004/0211682 | A1 | 10/2004 | Brander | |
| 2007/0056863 | A1 | 3/2007 | Chou | |

FOREIGN PATENT DOCUMENTS

| | | |
|---|---|---|
| DE | 42346332 | 4/1994 |
| EP | 0600535 | 6/1994 |
| EP | 0701955 | 3/1996 |
| EP | 1053944 | 11/2000 |
| FR | 2519840 | 7/1983 |
| FR | 2564807 | 11/1985 |
| FR | 2622551 | 5/1989 |
| FR | 2697809 | 5/1994 |
| FR | 2775261 | 8/1999 |
| NL | 8000159 | 8/1981 |
| WO | WO 8600275 | 1/1986 |
| WO | WO 8607036 | 12/1986 |
| WO | WO 93/06026 | 4/1993 |
| WO | WO 9306026 | 4/1993 |
| WO | WO 99/00314 | 1/1999 |

OTHER PUBLICATIONS

U.S. Appl. No. 12/514,564, filed May 12, 2009.
U.S. Appl. No. 11/559,653, Non-final rejection-Feb. 3, 2009.
U.S. Appl. No. 11/559,653, Office Action response-May 4, 2009.
U.S. Appl. No. 11/559,653, Final rejection-Aug. 14, 2009.

* cited by examiner

PACKAGING TRAY

CROSS REFERENCE TO RELATED APPLICATIONS

This application is the U.S. National Stage of International Application Number PCT/GB05/004936 filed on Dec. 20, 2005 which was published in English on Jun. 29, 2006 under International Publication Number WO 2006/067413.

TECHNICAL FIELD

The present invention relates to packaging trays particularly though not exclusively for food products, such as meat, liable to release an exudate during display prior to sale.

BACKGROUND OF THE INVENTION

Much of the meat bought by consumers is pre-packaged, particularly when for sale in supermarkets. The piece of meat is placed in a tray of plastics materials and covered with a transparent film. Meat is known to exude fluid, particularly blood, and this is considered unsightly in the base of the tray. To absorb this unsightly fluid, a pad is placed at the bottom of the tray and the meat is placed on the pad. Any exudate is absorbed by the pad and thus is not visible as a fluid in the base of the tray.

Meat pads generally consist of an upper release layer on which the meat rests and which allows for easy separation of the meat from the pad, and an absorbent lower layer. Meat pads must be sufficiently absorbent to absorb all the exudate from the meat placed on top thereof so that there is no unsightly pool in the tray, and yet must not leave any type of deposit on the meat. Various examples of meat pads exist in the prior art of varying complexity. Some meat pads are a simple piece of absorbent paper, others are multi-layered typically having a release layer and base layer and absorbent material in the middle. Different products are likely to exude different amounts of liquid, for example a lamb chop will exude a small quantity of liquid only, while a chicken for example, may exude a large amount of liquid. Thus foods need to be packed with a suitable amount of absorbency.

There are problems associated with the use of absorbent materials and these include the tendency for the absorbent material to leave fibres on the meat, or to remain adhered to the meat when it is taken from the tray and cooked. In addition the absorbent pad is often manufactured from a different material to the tray itself, thus making recycling more difficult.

SUMMARY OF THE INVENTION

The object of the present invention is to provide an improved packaging tray.

According to the invention there is provided a packaging tray comprising:

a an outer tray, having:
- a base and
- upstanding, side walls the base and the walls defining a packaging space and false bottom of the tray defining a discrete exudate-collection compartment immediately above the base and reducing the packaging space by the size of the discrete compartment, the false bottom being:
- peripherally connected to the side walls and—provided with an array of perforations in a discrete minor central region to allow exudate to pass through itself into the exudate-collection compartment; and means for gas transfer (e.g. channels) between the exudate-collection compartment and the packaging space, in addition to and separate from the perforations in the false bottom, and including means inhibiting flow exudate back into the packaging space.

It should be noted that goods packaged in the tray may be confined below the top of the side walls i.e. within the packaging space, such as where a steak is packaged, or they may extend above the top of the side walls i.e. above the packaging space, such as where a chicken is packaged. In some embodiments the side walls are reduced to produce an almost flat tray with only a slight rise up to a lip. After insertion of the goods, the tray will then be covered, typically by a transparent film, the cover being sealed to the lip of the side walls In addition, the gas may be air or may be a specific combination of gases to protect the contents of the packaging, and delay deterioration.

Normally the tray will be generally rectangular, that is with a rectangular base and four upstanding walls, although other shapes can be envisaged. It can be envisaged that the false bottom could be a thermoformed member inserted into the tray, the insert having ribs for holding it off the base and perforations for allowing exudate to pass into the exudate-collection compartment.

However in the preferred embodiment, the false bottom is a plastics material film placed in the tray.

In some embodiments the film may be adhered directly the to the upstanding side walls. However, in other embodiments, the tray may be provided with a step in the side walls at which the film is at least intermittently attached. In other embodiments a step may be provided along one, two or three of the side walls with the film being adhered directly to the upstanding side walls on the remaining one, two or three sides. In further embodiments the step may be displaced from the side walls toward the centre of the tray.

Advantageously, in some embodiments, the base may include a series of members upstanding from the base for support of the film. Whilst it is envisaged that the upstanding members may be undulations, they are preferably ribs: the intended distinction being that that a rib is taller than it is wide, an undulation is wider than it is tall.

In a preferred embodiment, the base is provided with a set of central ribs arranged around the central region, and a set of higher radial ribs, extending from the side walls to the central region.

Preferably, the attachment of the film to the step is a continuous weld, although spot welds can be envisaged.

While the exudate-collection compartment will generally extend above the base, in some embodiments it may also extend along one or more of the side walls.

Normally, the false bottom will slope in towards the centre of the tray with perforations being provided centrally. However, it is equally envisaged that the false bottom could be provided uniformly with perforations or be provided with a regular array of perforations to be spaced between the ribs.

The ribs may have a simple ridge or may be provided with a central channel. In some of these ribs the film is may be sealed into the channel to guide exudate to a central depression. In others of these ribs, the film may be sealed over the channel to provide for gas transfer between the exudate-collection compartment and the packaging space.

Again, it can be envisaged that the ribs could radiate from the central depression, formed by the ribs being lower in the centre of the tray. However in the preferred embodiment, radial ribs terminate short of a set of lower, central ribs arranged around a central region. The central region and the central ribs being arranged in the same general shape as the tray and its side walls. The perforations are provided in the film only in the central region.

The preferred tray has:

four side walls;

a base; the base having a step around the periphery of the base a recessed central portion a first set of ribs in the recessed portion, the first ribs sloping down towards and defining a central region, the ribs having a central channel;

a second set of ribs extending from the corners of the central region to the corners of the base and side walls, the ribs having a channel, the channel extending up the corners of the side walls a film across the recess in the base and welded to the step, the film having:

an array of apertures over the central region the film being welded into the channel on the first set of ribs and being welded over the channel on the second set of ribs.

Any liquid placed on the surface of the film, for example if exuded from a piece of meat in the tray, will run down the surface of the film, following the contours of the first set of ribs, to the array of apertures above the central region. The liquid will then pass through the apertures into the central region, and disperse throughout the recessed portion of the tray base. If the tray is tipped, the liquid will collect in the recessed base away from the central region and thus not pass out of the tray.

The channels in the diagonal ribs provide venting from the recessed portion, allowing air to pass from the central region to the edges of the tray. Importantly, the venting is provided away from and above the apertures forming the entrance into the exudate-collection compartment.

Preferably the tray, including the film can all be made from polypropylene plastics material. This will allow the entire tray to be recycled. Typically the film will be 25 μm bi-axially oriented polypropylene film. Alternatively the tray can be made from expanded polystyrene, possibly having a polyethylene or polypropylene film coating, or any other thermoformable plastics material.

Preferably the fray and the film have surfactant applied thereto. This may be achieved by coating the tray and film in surfactant, or coating certain areas with surfactant, or alternatively the surfactant may be a constituent of the plastics material from which the tray and film are made.

Preferably the ribs are dis-continuous and may have gaps to allow free flow of exudate within the recessed base of the tray.

Advantageously, the film may be sealed into the channels on the first set of ribs providing a channel below the meat along which exudate may flow into the fray.

BRIEF DESCRIPTION OF THE DRAWINGS

To help understanding of the invention, a specific embodiment thereof will now be described by way of example and with reference to the accompanying drawing, in which.

DETAILED DESCRIPTION

Figure 1:
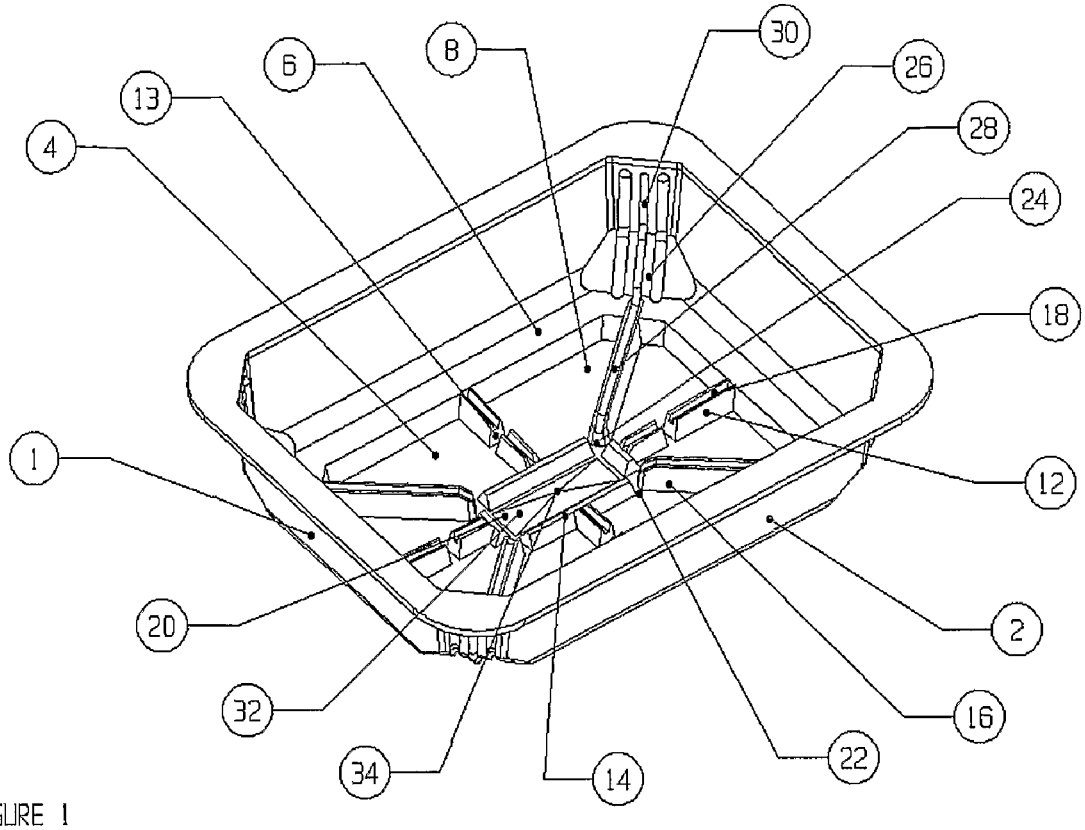
FIG. 1 is a perspective view of a tray according to the invention but without the film.
Figure 2:
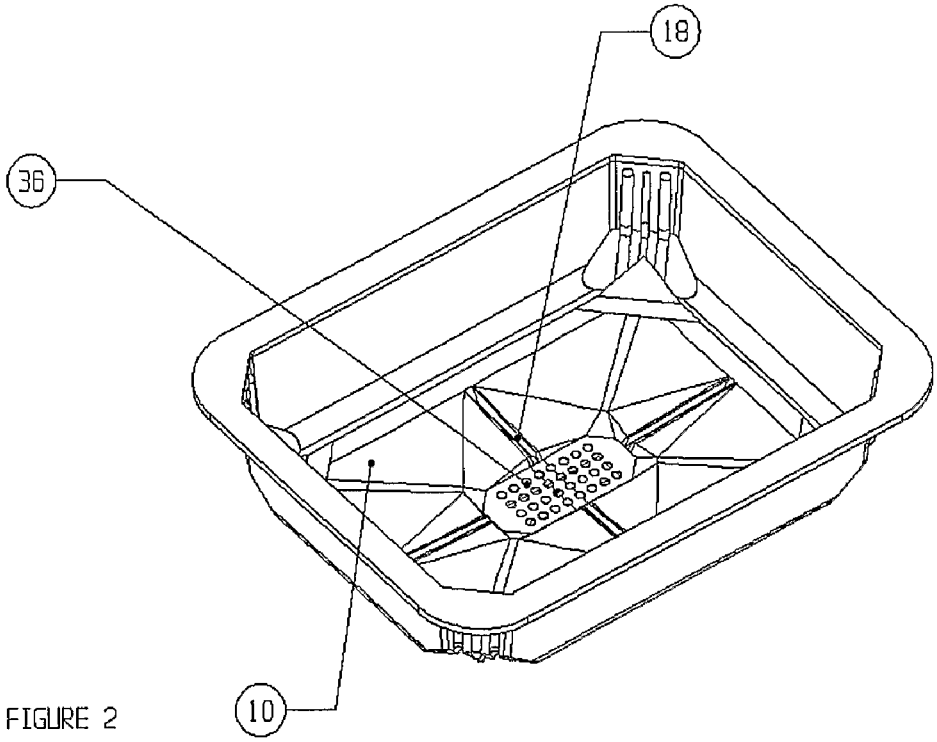
FIG. 2 is a perspective view of the toy of FIG. 1, including the film in position but not welded to the tray.
Figure 3:
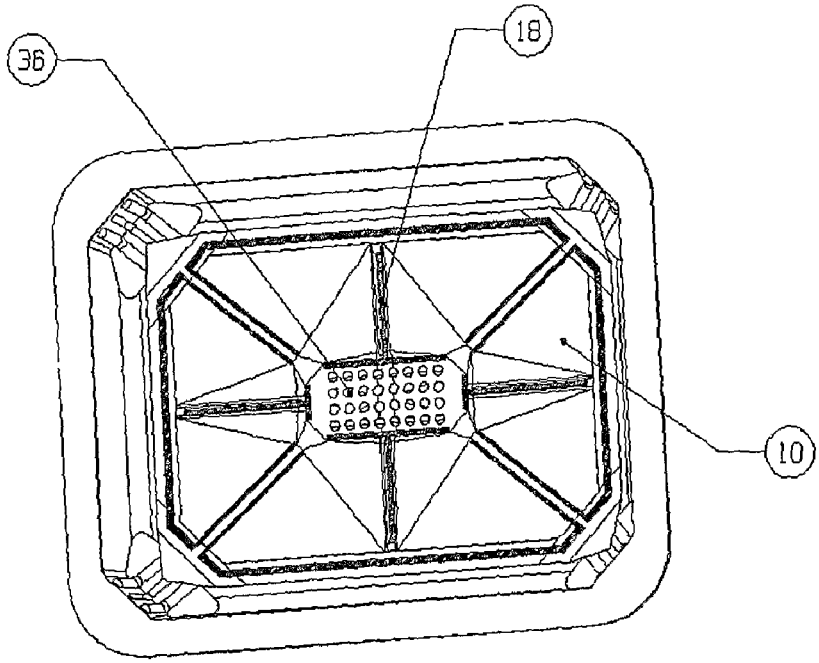
FIG. 3 is a perspective view of the tray of FIG. 2 in which the film has been welded into position.

Turning to FIGS. 1, 2 and 3 the tray 1 as shown has four side walls 2 and base 4. The base 4 includes a step 6 and a recessed area 8. Across the recessed area 8 is secured a plastics material film 10, acting as a false bottom. This is welded to the step 6.

The recessed area 8 is provided with three sets of projecting ribs 12, 14, 16. One set of ribs 12 extends from the side walls of the recessed area 8 in the tray towards the centre of the tray. These ribs 12 are shallowly angled so that the film, resting on the ribs, slopes down toward the centre of the tray. In addition not all of these ribs are continuous, but gaps 13 are left, to enable a liquid to flow within the recessed base. The ribs are provided with channels 18 in their tops.

A second set of ribs 14 surround the centre of the tray, which form a central region 20, and are at the height slightly lower than the first set of ribs, creating a dip in the film. The ribs 14 do not completely enclose the region 20, but passages 22 are left for liquid to flow into the rest of the recessed area 8.

A third set of ribs 16 extend from the corners 24 of the central region 20 to the corners 26 of the tray. These ribs are also provided with channels 28 in their tops, the channels in the ribs extending into a channel 30 in the corners 26 of the tray. The central region 20 is provided with a shallow pyramid 32 projecting into the recessed area by a small amount, such that any fluid falling on to the region will flow down the pyramid into the rest of the recessed area. The top of the pyramid 34 is below the height of the ribs 14.

The film is welded to the tray circumferentially at the step 6. It is also welded into the channels 18 of the first set of ribs 12, and along the tops of the second set of ribs 14. However the film is welded across the channels 28 of the third set of ribs, thus leaving the channels connected to the atmosphere and body of the tray.

The film is provided with an array of apertures 36 corresponding to the portion over the central region 20. These apertures are large enough to allow exudate from the meat to pass through. However the apertures are not so large that the film cannot bear the weight of the meat, causing the film to rupture.

The tray can be used for holding a piece of meat for sale, typically on a supermarket shelf. The meat will be placed in the tray on the film and the top of the tray will be sealed with a further film. Exudate from the meat will pass through the larger apertures 36 into the recessed area 8 of the tray. Initially the exudate will pass onto the central region 20, but will run off the region and into the rest of the recessed area 8. As the ribs 12 slope toward the central region 20, any exudate on the upper surface of the film will run towards the central region, where it will pass through the apertures and into the recessed portion. In addition, the exudate can flow through the channels 18 in the first set of ribs under the meat, but on the film.

The piece of meat or the like on the top of the film may completely cover the apertures, depending upon the size and shape of the meat. The could prevent any exudate entering the recessed area, even by passing though the channels under the meat, as the displace air would not be able to escape, a process known as air blocking. However, the channels 28, running from the central region to the corners of the tray underneath the film provides permanent air passages preventing the formation of an air lock. Thus enable exudate to pass into the recessed area 8. Once exudate has passed through the apertures 36 and from the central region 20, into the main recessed area 8, it is captured. If the tray is tilted to one side, the exudate will pool along that side of the tray, where it is trapped against the film within the recessed area. The volume of the recessed area is such that it will hold any expected exudate in the areas around the central region, with no risk, even when tipped, of the exudate flowing back out of the apertures 36. If the tray is turned upside down, then the exudate will flow around the outside edges of the recessed portion, on the film. As the film has no apertures apart from in and around the central portion, there will be no leakage. Due to the pyramid 32 there will be essentially no liquid directly beneath the apertures, and thus there will be essentially no passage of exudate back through the apertures, even in the inverted position.

The recessed area 8 may be provided with some absorbent material, to absorb any exudate. However, this is generally considered to be unnecessary as the exudate is trapped in the recessed area and will not leak. However, the absorbent material will prevent the exudate from moving about in the recessed area 8 and can be advantageous for this reason. Such absorbent material may include super absorbent material in the form of fibre or powder, either alone or in combination with other absorbent materials. As any absorbent material will be placed in the recessed area 8 and is separated from the contents of the package by the film 10, there is no danger of it contacting the contents and contaminating it.

In another use of the tray may also be used as a food cooking vessel. Ready meals are popular among consumers and there is an increasing demand for ready meals that are considered "healthy", for example containing less fat and being freshly cooked. One type of ready meal consists of a selection of raw ingredients, for example a piece offish or chicken with some vegetables, herbs, spices etc, the whole contained being adapted to be placed in the microwave and cooked. A small amount of liquid is placed in the base of the container and the shape of the container means that the food is cooked by the steam produced from the water. As the liquid is no separated from the food, the lowermost part of the food will effective boil in the heated liquid. Thus the upper and lower parts of the food will cook at different rates. This is not entirely satisfactory. The tray of the present invention can also be used for this steam cooking of food. The food can be placed on the film 10 in the normal manner and in this case liquid, typically water or possibly wine, can be placed in the tray where it will settle in the recessed area 8. Thus the food does not sit in a pool of liquid. The tray is also covered with a single or double layer of protective film and sold at a supermarket. To cook, a user would pierce the top film and place the tray in the microwave, where the liquid would turn to steam that would cook the food. Alternatively if a double layer of film was provided, the user would remove the upper layer to leave the lower layer which would already be provided with the necessary apertures.

In another use, the tray can be used to drain any fat that exudes from food during cooking. For example a certain amount of fat often drains out of sausages during cooking. By placing the sausages in the tray of the present invention and cooking them, any liquid fat produced during the cooking, will drain into the recessed portion, as described above, separating the fat from the food.

The tray can also be used to transport certain foodstuffs that are usually packaged in ice, for example fish. The fish can be placed on the film 10 of the tray of the invention, the tray being sized to fit the fish, and covered with ice. The tray can be made of an insulating material, or more typically can then be placed in an expanded polystyrene box, providing insulation and support. As the ice melts it will drain into the recessed area, thus preventing the fish from sitting in a pool of water, which will cause deterioration of the flesh. For this purpose the recessed area will be quite large and is likely to be filled with an absorbent material including super-absorbent material, although this is not essential.

Figure 4:
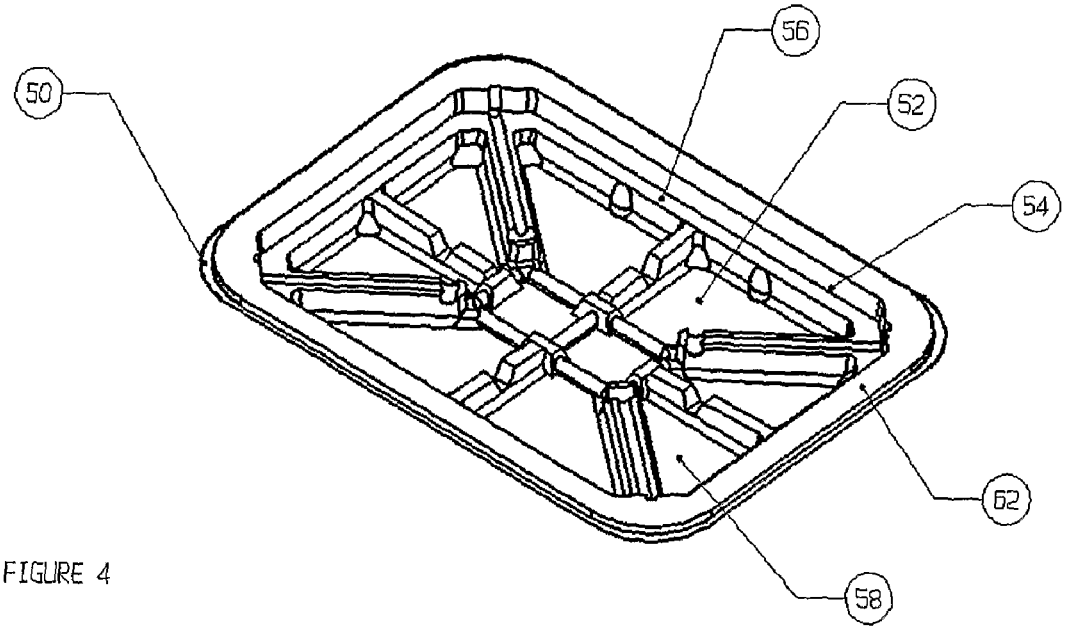
FIG. 4 is a perspective view of a second tray according to the invention.
Figure 5:
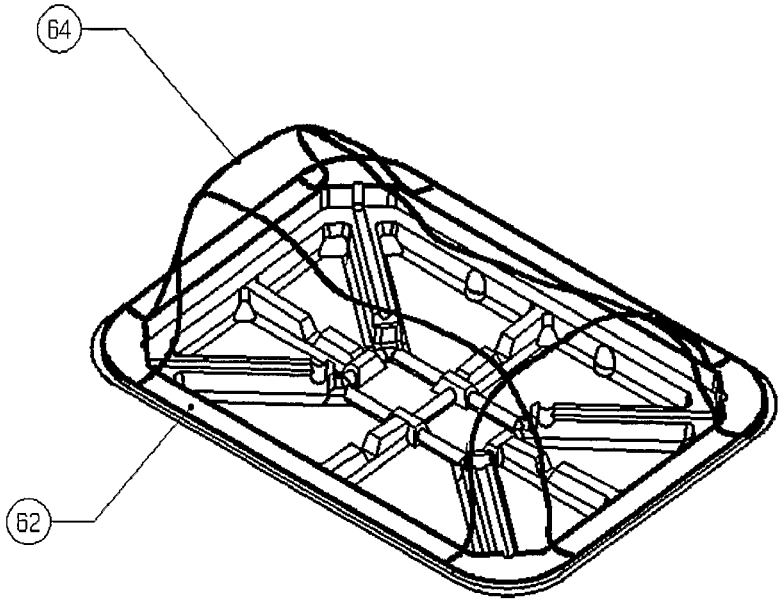
FIG. 5 is a perspective view of the second tray with outer film.

Now turning to FIGS. 4 and 5, the tray 50 there shown includes the base 52, side walls 54, step 56, recessed area 58 and ribs as described in relation to the first embodiment. Film is welded to the ribs same as shown 10 in FIG. 3. However, in this embodiment the side walls are very short. A lip 62 is provided on the top of the side walls 54. In use, a piece of meat is placed on the tray, on the film and is covered by a stretch type protective film 64. FIG. 4 shows the tray alone, and FIG. 5 shows the tray with a protective film. This protective film is sealed to the lip 62. By reducing the size of the side walls, the amount of packaging material is substantially reduced, reducing the cost of the packaging. The tray is provided with minimal side walls to contain any exudate from the goods placed on the tray before the tray is covered with the stretch type protective film. The presence of the side walls prevents the exudate spreading on to the lip 62 which would cause difficulties in sealing the stretch type protective film thereto.

Figure 6:
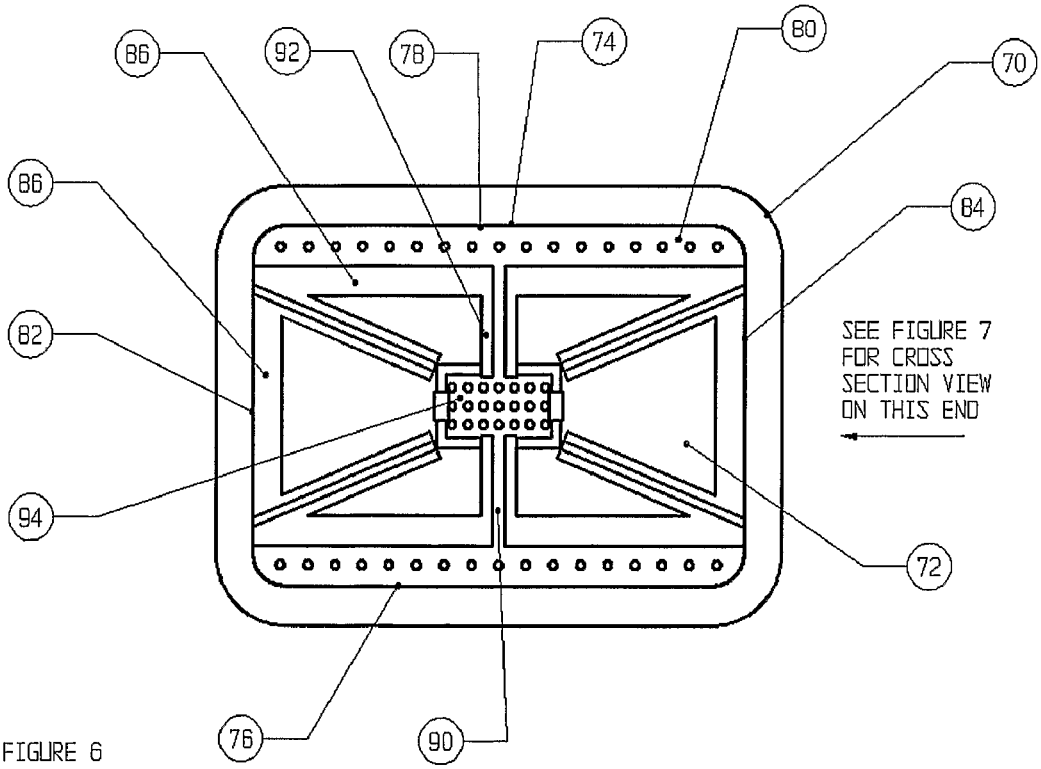
FIG. 6 is a top view of a third tray according to the invention.
Figure 7:
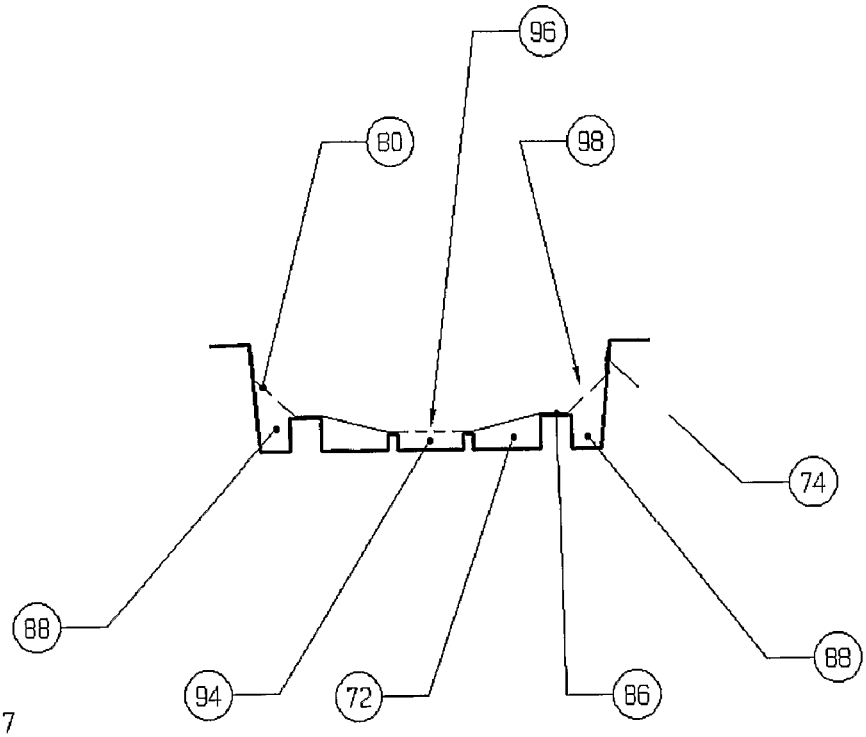
FIG. 7 is a sectional view of the tray of FIG. 6.

Now referring to FIGS. 6 and 7, the tray there shown 70 also includes a base 72 and side walls 74. This tray 70 is designed to be displayed substantially on one of its long sides 76, 78, and to collect exudate when displayed in this way.

As with previous embodiments, the tray is provided with a film 80 providing a false bottom to the tray. On the shorter two sides 82, 84, the film is welded to a step 86, as in the previous embodiments. However, on the longer two sides, the step 86 is off-set from the side walls 76, 78 and the film is welded to the step 86 and to a position approximately halfway up the side walls. Thus a channel 88 is created between the longer side walls and the off-set step 86.

This channel is separated from the rest of the recessed base 72 of the tray by the step 86. However, the step 86 is not continuous but has a gap 90 formed by parallel ribs 92 connecting to the central region 94 of the tray. The central region 94 being the same as described in relation to FIG. 1.

The film 80 is provided a first series of apertures 96 over the central region 94, equivalent to those described in relation to the embodiment of FIG. 1, and a second set of apertures 98 over channel 88.

Thus in use, when the tray is holding a piece of meat, for example, and is stored on its base, as described in reference to FIG. 1, any liquid exuding from the meat is able to drain along the film 80 to the first series of apertures 96 over the central region 94 and into the central region where it is able to flow into the recessed base 72, within the area defined by the step 86.

However, if the tray is positioned on one of its long sides, any liquid exuding from the meat is able to drain through the second set of apertures 98 into channel 88. Here is it contained within the channel 88 and cannot flow back into the body of the tray 70. However, there will be essentially no flow of exudate from the base 72 into channel 88 and conversely the exudate in channel 88 can not flow back into the body of the tray when the tray is located on the substantially side position. Yet air can flow between the body of the tray, the recessed based 72 and channel 88 and thus no air lock should occur.

When the tray is subsequently placed back onto its base, any exudate that the collected in channel 88 can now flow between ribs 92 towards the central region 94 and into the base 72.

The means of venting in this tray is slightly different from the previously described embodiments. In the previous embodiment, channels have been provided in some of the ribs allowing air to pass along these channels to the corners of the tray and out to atmosphere. However in this current embodiment the film 80 is sealed to the side walls 82, 84 along their entire length with no gaps in the corners. The venting is provided though the apertures 98 over the channel 88. When the tray is lying flat on its base, air can escape by passing through these apertures. Due to the position on these apertures there can be no leaking of liquid therefrom. When the tray is placed on its side for display purposes, one set of apertures will be beneath the contents of the tray to allow any exudate to pass into the channel 88, while the other set of apertures will be raised higher, allowing for venting. Thus there is always means for air escape from the base of the tray to the body of the tray thus preventing air blocking.

Figure 8:
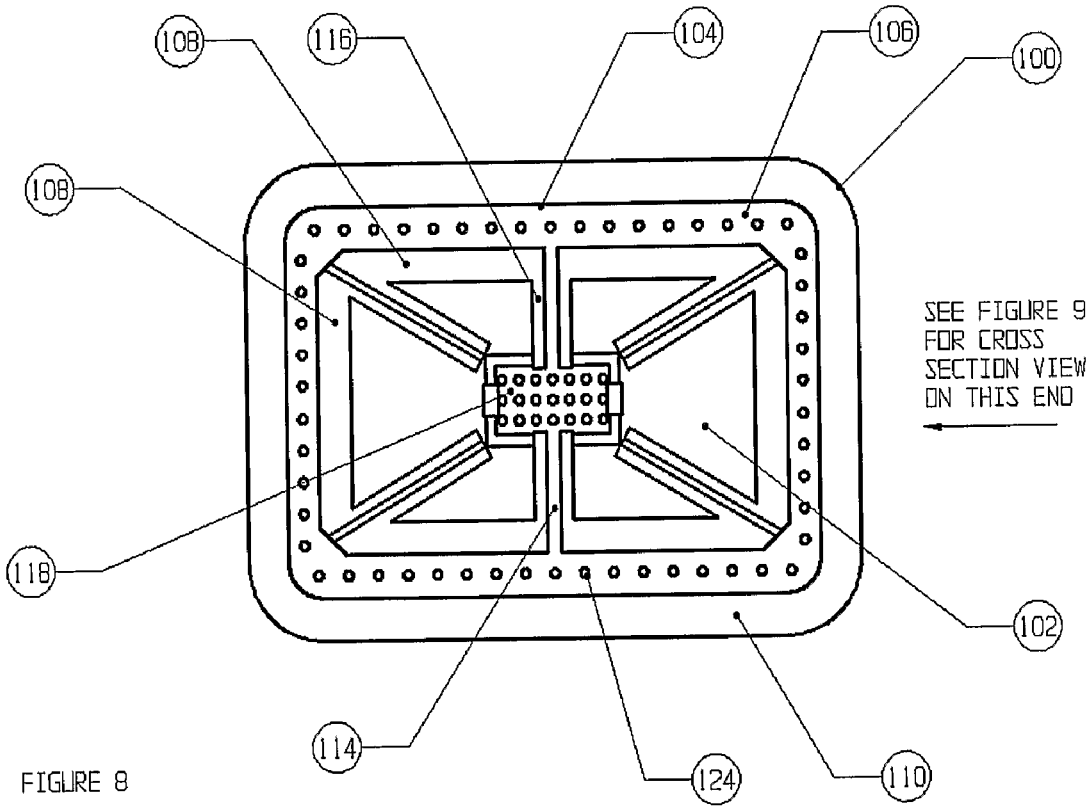
FIG. 8 is a top view of a fourth tray according to the invention.
Figure 9:
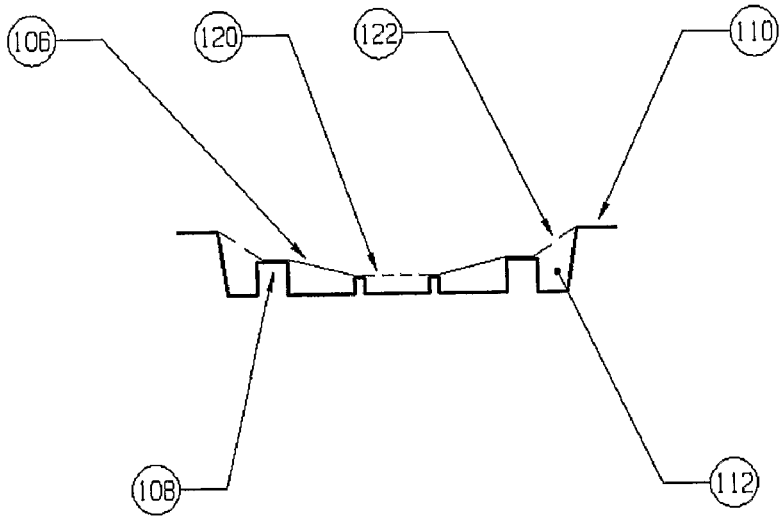
FIG. 9 is a sectional view of the tray of FIG. 8.

The embodiment shown in FIGS. 8 and 9 is similar to the one shown the FIGS. 6 and 7, except the film extension is provided on all four sides and is welded to the top lip rather than halfway up the sidewalls. As shown this tray 100 includes a base 102 and four side walls 104. The base 102 of the tray 100 is provided with ribs as described in relation to the first embodiment.

As before the tray also includes a film 106 forming a false bottom. The film 106 is welded to a step 108 in the tray, the step being off-set from the side walls 104, and also welded to the lip 110 on top of the side walls 104. As before the off-set step 108 provides a channel 112 between the side walls 104 and the step 108, the step 108 separating the channel from the rest of the base 102. As described above, the channel is not continuous, but is provided with a gap 114 connecting the channel to the rest of the base 102. Ribs 116 extend from the gap to the central region 118 (the central region being described more fully in relation to the earlier embodiments).

The film 106 is provided with a set of apertures 120 over the central region 118 and with a second set of apertures, 122, this comprising a row 124 of apertures over the channel.

In use, when a piece of meat or the like, is placed on the tray, any liquid exuding from the meat should drain along the film 106 and pass through the first set of apertures 120 into the central region, where it is able to flow through the base 102. If the tray is positioned on any of its sides 104, any exudate can pass though the second set of apertures 122 into the channel, and once the tray is again placed on its base it will flow through the gap 114 and ribs 116 into the central region of the tray.

As with the previous embodiment the venting is through the row of apertures 124 above the channel 112.

Figure 10:
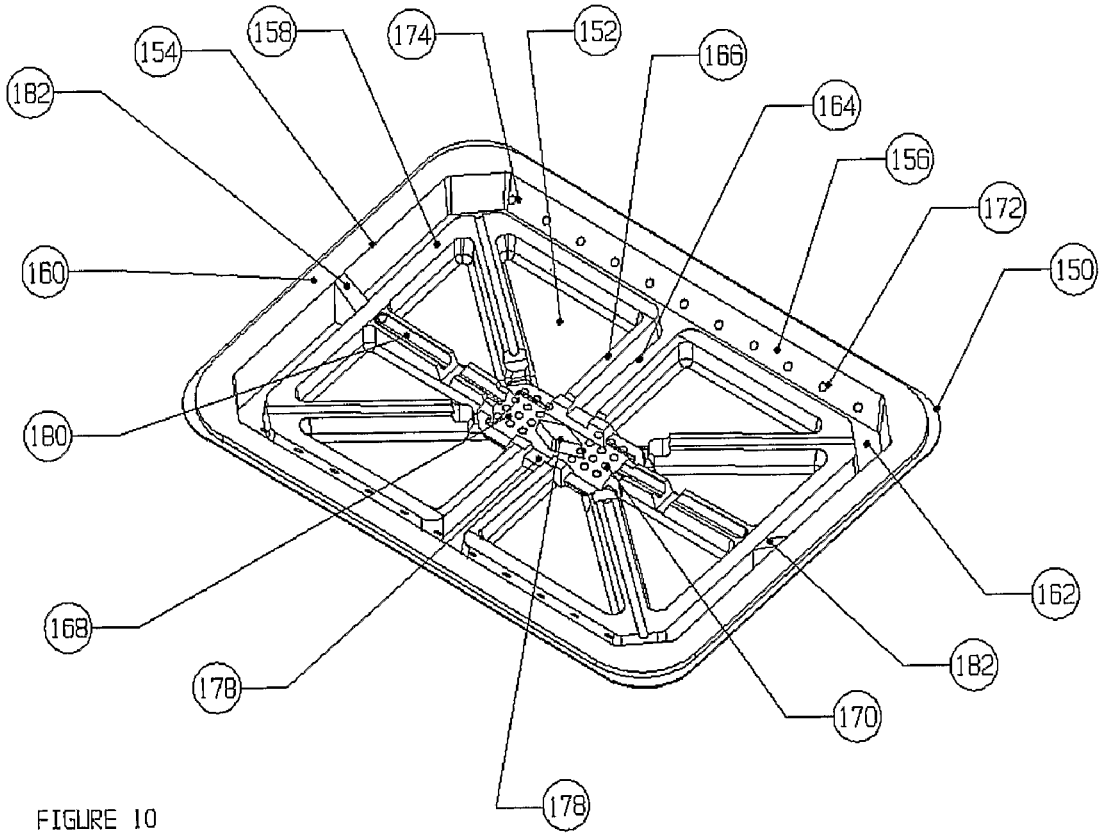
FIG. 10 is a perspective view of a fifth tray according to the invention.

The embodiment shown in FIG. 10 is similar to the one shown in FIGS. 8 and 9, except there are two fluid channels running into the centre of the tray and there are fluid control baffles in the central region. As shown this tray 150 includes a base 152 and four side walls 154. The base 152 of the tray 150 is provided with ribs as described in relation to the first embodiment.

As before the tray also includes a film 156 forming a false bottom. The film 156 is welded to a step 158 in the tray, the step being off-set from the side walls 154, and also welded to the lip 160 on top of the side walls 154. As before the off-set step 158 provides a channel 162 between the side walls 154 and the step 158, the step 158 separating the channel from the rest of the base 152. As described above, the channel is not continuous, but is in two halves separated by webs 182 and provided with a gap 164 connecting the channel to the rest of the base 152. Ribs 166 extend from the gap to the central region 168. The film forming the false bottom is also welded into channels 180 so that fluid can run down on top of the film but in these channels and under the contents of the pack and so be directed to the central region 168 under the pack contents, (the central region being described more fully in relation to the earlier embodiments).

The film 156 is provided with a set of apertures 170 over the central region 168 and with a second set of apertures, 172, this comprising a row 174 of apertures over the channel 162.

In use, when a piece of meat or the like, is placed on the tray, any liquid exuding from the meat should drain along the film 156 and under the meat via the channels 180 then pass through the first set of apertures 170 into the central region, where it is able to flow through into the base 152. If the tray is positioned on any of its sides 154, any exudate can pass though the second set of apertures 172 into the channel, if the tray is tilted from side to side the exudate will tend to flow through the gap 164 and ribs 166 into the central region of the tray.

As with the previous embodiment the venting is through the row of apertures 174 above the channel 162.

The central region 168 is provided with a series of baffles 178, to direct the flow of exudate away from the central region and into the base area 152. In particular, when the tray is tilted from side to side, the exudate that has built up in the channel 162 will tend to flow back between the ribs 166 toward the central region, here the baffles 178 will tend to direct the flow of exudate to be captured and dispersed into the recessed portion 152.

The invention is not intended to be restricted to the details of the above-described embodiment.

What is claimed is:

1. A packaging tray comprising:

an outer tray, having:

a base, itself having a recessed area of the base, a central, at least partially recessed region of the base and a set of ribs upstanding from the base and extending radially from the central region, the ribs having tops formed with channels, a step above the recessed area of the base at least substantially around the recessed area and continuous with the ribs where the ribs and the step meet and side walls, surrounding and upstanding from the base, the base and the walls defining a packaging space and a false bottom of the tray, the false bottom being:

supported above the base by the ribs, thereby defining a discrete exudate-collection compartment immediately above the base and reducing the packaging space by the size of the discrete compartment, provided with an array of perforations in a discrete minor central region of the false bottom, to allow exudate to pass through into the exudate-collection compartment, sealed to the tops of the ribs alongside the channels, thereby providing means, in addition to and separate from the perforations, for gas transfer between the exudate-collection compartment and the packaging space at the side walls, and peripherally connected to the side walls and sealed to the step, thereby providing in conjunction with the sealing of the false bottom to the ribs means for inhibiting flow of exudate back into the packaging space, the step extending partially around the foot of the side walls and partially set in from the side walls, being spaced therefrom by at least one channel, which extends the exudate-collection compartment.

2. A packaging tray as claimed in claim 1, wherein the step is at least substantially continuous around the foot of the side walls.

3. A packaging tray as claimed in claim 2, wherein the grooves in the ribs continue across the step and up the side walls.

4. A packaging tray as claimed in claim 2, wherein the connection of the false bottom to the side walls is via the step to which the false bottom is sealed.

5. A packaging tray as claimed in claim 1, wherein the step is spaced from the side walls by at least one channel, which extends the exudate-collection compartment.

6. A packaging tray as claimed in claim 1, wherein the connection of the false bottom to the side walls is by sealing of the false bottom to the side walls in addition to sealing to the step.

7. A packaging tray as claimed in claim 1, wherein the connection of the false bottom to the side walls is by sealing of the false bottom to lips extending out from the side walls in addition to sealing to the step.

8. A packaging tray as claimed in claim 1, wherein the side walls are reduced to produce an almost flat tray with only a slight rise up to a lip.

9. A packaging tray as claimed in claim 1, wherein the tray is covered, typically by a transparent film, the cover being sealed to a lip of the side walls.

10. A packaging tray as claimed in claim 1, wherein the gas is air.

11. A packaging tray as claimed in claim 1, wherein the gas is a specific combination of gases to protect the contents of the packaging, and delay deterioration.

12. A packaging tray as claimed in claim 1, wherein the tray is generally rectangular, that is with a rectangular base and four upstanding walls.

13. A packaging tray as claimed in claim 1, wherein the false bottom is thermoformed member inserted into the tray.

14. A packaging tray as claimed in claim 1, wherein the false bottom is a plastics material film placed in the tray.

15. A packaging tray as claimed in claim 1, including a set of central ribs arranged around the central region of the base.

16. A packaging tray as claimed in claim 15, wherein the central region and the central ribs are arranged in the same general shape as the tray and its side walls.

17. A packaging tray as claimed in claim 1, wherein the attachment of the false bottom to the step is an at least substantially continuous weld.

18. A packaging tray as claimed in claim 1, wherein the false bottom slopes in towards the central region.

19. A packaging tray as claimed in claim 1, including at least one additional rib without a central channel.

20. A packaging tray as claimed in claim 1, including at least one additional rib having a channel into which the false bottom is sealed providing a channel to guide exudate along the false bottom to the perforations in the central region and hence into the exudate-collection compartment.

21. A packaging tray comprising:

an outer tray, having:

a rectangular base, itself having a recessed area of the base, a central, at least partially recessed region of the base, a first set of ribs upstanding from the base and extending radially from the central region to the corners of the rectangular base, the ribs having tops formed with channels, and a second set of ribs upstanding from the base and extending radially from the central region to the sides of the base, the ribs having tops formed with channels, a step above the recessed area of the base at least substantially around the recessed area and continuous with the ribs where the ribs of both sets and the step meet and side walls, surrounding and upstanding from the step around the base, the base and the side walls defining a packaging space and a false bottom of the tray, the false bottom being:

of plastics material film, supported above the base by the ribs, thereby defining a discrete exudate-collection compartment immediately above the base and reducing the packaging space by the size of the discrete compartment, provided with an array of perforations in a discrete minor central region of the film, to allow exudate to pass through into the exudate-collection compartment, sealed over the channels in the tops of the ribs of the first set, thereby providing means, in addition to and separate from the perforations, for gas transfer between the exudate-collection compartment and the packaging space at the side walls, and peripherally connected to the side walls and sealed to the step, thereby providing in conjunction with the sealing of the film to the ribs means for inhibiting flow of exudate back into the packaging space and welded into the channels in the tops of the ribs of the second set, thereby providing gutters for flow of exudate to the perforations, the step extending partially around the foot of the side walls and partially set in from the side walls, being spaced therefrom by at least one channel, which extends the exudate-collection compartment.

* * * * *